US005365746A

United States Patent [19]

Warner et al.

[11] Patent Number: 5,365,746

[45] Date of Patent: Nov. 22, 1994

[54] CRYOGENIC COOLING SYSTEM FOR AIRBORNE USE

[75] Inventors: H. Burt Warner, Orange; Matthew M. Skertic, Chatsworth; Roy B. Hasselquist, Malibu; Joseph L. Hlava, Woodland Hills, all of Calif.

[73] Assignee: Hughes Aircraft Company, Los Angeles, Calif.

[21] Appl. No.: 300,522

[22] Filed: Jan. 23, 1989

[51] Int. Cl.[5] ..... F25B 19/02

[52] U.S. Cl. ..... 62/51.2; 244/3.16

[58] Field of Search ..... 244/3.1, 3.16; 62/51.2

[56] References Cited

U.S. PATENT DOCUMENTS 4,155,521 5/1979 Evans et al. ..... 244/3.16

4,690,351 9/1987 Beckerleg et al. ..... 244/3.16

*Primary Examiner*—David Brown

*Attorney, Agent, or Firm*—Charles D. Brown; Randall M. Heald; Wanda K. Denson-Low

[57] ABSTRACT

An airborne cryogenic cooling system in which a first cryogenic material located within an on-board container is cooled to the solid state prior to launch a remotely located second cryogen conduited to the container. Immediately prior to becoming airborne connection is broken to the second cryogen and on-board cooling is achieved by venting the container to space environment causing sublimation of the solid first cryogenic, or, alternatively, the container may be left sealed and cooling results from triple-point transition of the solid cryogen.

13 Claims, 3 Drawing Sheets

CRYOGENIC COOLING SYSTEM FOR AIRBORNE USE

BACKGROUND OF THE INVENTION

1. Field of the Invention

The present invention relates generally to cryogenic cooling systems, and, more particularly, to such cooling systems especially useful in environments where weight and space requirements are at a premium.

2. Description of Related Art

There are an increasing number of devices which for proper operation require cooling to very low temperatures. For example, certain infrared detectors used in heat seeking missile guidance systems require cryogenic cooling.

In the past where such cryogenic cooling was needed on board a missile, for example, the cooling could only be satisfied by the use of a cryosystem which added an excessive amount of weight. For example, conventional on-board cryosystems typically consisted of Joule-Thomson gas liquifying cryostats, stored high pressure gas bottles, and control and pressure regulating valves, which added weight generally in excess of one pound, and additional cost to the missile vehicle. The weight from such a system is prohibitively large for some missile system requirements.

Another past approach has been to provide a mechanical closed-cycle refrigerator such as a split-Stirling cryoengine having a weight of several pounds, making it even less desirable from the weight standpoint.

Still other types of cooling systems used in space satellite vehicles have used solid cryogen coolers. These have generally been very large in size to provide cooling over many months duration while in space. In these cooling systems, the solid cryogen is frozen in place, or inserted as a prefrozen slug, just prior to launching the vehicle into space. Cooling is achieved by virtue of the latent heat of sublimation achieved by sublimating the solid cryogen into space vacuum. Such systems are for one-shot use only and also require that the cryogen vapor venting be pressure controlled.

Adequate external coolant is generally available on the missile launcher or launch platform to cool down the infrared detector and to maintain its operation in a standby mode prior to missile launch. It is, therefore, highly desirable to be able to provide a cryogenic system for airborne vehicles, such as missiles, for example, which would provide cooling for launch readiness through the use of an external precoolant and that would maintain the cooling with a very small solid cryogen phase change cooler placed next to the infrared detector, without the need to supply cryogen continuously during missile flight, as is the case with gas fed Joule-Thomson cryocoolers or a closed cycle mechanical refrigerator.

SUMMARY OF THE DISCLOSURE

In accordance with the present invention there is provided a cryogen cooler which includes as a primary cooling element, a solid cryogen pellet that is built integral with the infrared detector housing, and is frozen by a secondary cryocooler operating from a cryogen source located externally of the missile. At the time of launch, the secondary cryocooler is disconnected and the latent heat of the phase change of the solid cryogen, as it melts into a liquid, or sublimates into a vapor, effects cooling for the apparatus during missile free flight.

Depending upon the missile, the time for on-board use of the cryocooler can vary from 15 seconds to 1000 seconds. The described cooling system can be initially cooled by a secondary cooler that may either be a liquid cryogen, or, alternatively, a Joule-Thomson cryostat utilizing gas input as the secondary cryocooler.

Accordingly, the one to three pound weight of a conventional on-board cryosystem can be replaced by a system having a very light housing within which only a few grams of solid cryogen are contained and which is adequate to provide cooling for a typical 15 to 1000 second missile flight duration.

Optionally, a closed-loop temperature conditioning control may be utilized to maintain the temperature within some required predetermined range.

DESCRIPTION OF THE PREFERRED EMBODIMENTS

Figure 1:
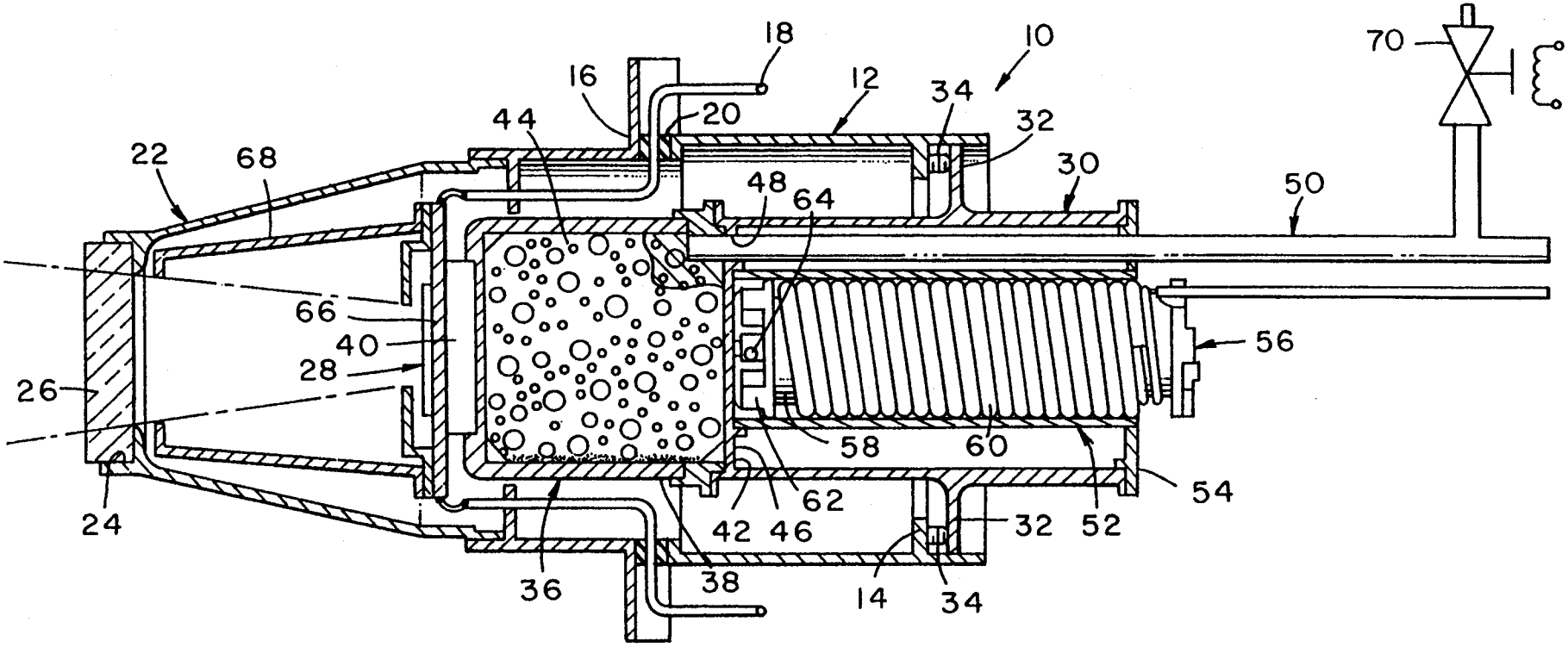
FIG. 1 is a side elevational, sectional view of the cryogenic cooling means of this invention particularly for use with a Joule-Thomson cryostat.

With reference now to the drawings and particularly FIG. 1 there is shown enumerated as 10 a cryogenic cooling system in accordance with the present invention which is shown incorporated as a unit with an infrared sensor requiring cooling for satisfactory operation. The unit comprises an infrared detector, dewar or vacuum housing package, and primary and secondary cryocooler stages. The secondary cooling stage can be a Joule-Thomson (J-T) cryostat.

An outer housing member 12 is elongated, open-ended and tubular, and terminates at one end in a radial flange 14. The housing member joins at the open end to an electrical feedthrough header 16 containing a series ring of kovar pins 18 which pass through glass vacuum seals 20. The header is further joined to a conical wall member 22 with an open end 24 within which a window 26 is fastened for transmitting light energy onto an infrared detector 28.

A hollow support cylinder 30 with a centrally located radial flange 32 is slidingly received within housing 12 and secured against the inwardly directed flange 14 by threaded means 34, for example. The support cylinder joins a cryocell 36 of hollow metal walled construction having an outer metal wall 38 which abuts against pedestal 40 in good thermally conductive relationship, the side opposite being open at 42. The interior chamber of the cryocell is filled with a metal foam 44 (e.g. aluminum or copper) to enhance thermal equilibrium throughout the interior. The open side 42 is enclosed by a cover plate 46 having an opening 48 within which tubing 50 is inserted, via which the primary cryogen (e.g. propane) is added. During assembly, the cryocell chamber is charged with a gaseous liquid cryogen (e.g. propane) along tubing 50 which is then sealed off in any conventional manner.

An open-ended metal tube 52 is concentrically located within support member 30 and secured by a radially inwardly directed flange 54. The other end of tube 52 joins plate 46.

A Joule-Thomson cryostat 56 is seen to include a generally cylindrical body member 58, with a helical winding of hollow finned heat exchanger tubing 60 arranged thereabout and enclosed at its inner end by a metal cap 62, which can be slidably positioned within the open end of the tube 52 so that it is fully located within the tube and very closely adjacent the cryocell 36 as shown in FIG. 1. Liquified cryogen from a cryostat gas expansion orifice 64, located at the end of tubing 60, is sprayed onto the cryocell 36 when the cryostat is operative in the prelaunch mode.

The apparatus to be cooled can take many forms, but for present purposes it is considered to include a ceramic mounting board 66 constructed of alumina, for example, centrally located on the outside of the pedestal 40. The infrared focal plane array 28, which can be a mercury-cadmium-telluride detector array and readout integrated circuit chip, is secured to the opposite side of board 66. An open-ended tubular light radiation shield 68 has one end secured to the circuit board 66, and the other end directed oppositely. Electrical connection with the circuit board and thus to the focal plane array is accomplished via feedthrough pins 18.

In use of the system shown in FIG. 1, it is assumed that the missile is in prelaunch condition and that the Joule-Thomson cryostat 56 is in position within the tube 52. The cryogen (propane) in the cryocell 36 is cooled to the desired temperature which freezes the cryogen into a solid pellet by thermal contact with the liquified secondary cryogenic gases which flow through the heat exchanger tubing 60 and gas expansion orifice 64. At missile launch, secondary cooling by means of the Joule-Thomson cryostat 56 is discontinued by shutting off the external source of cooling gas which flows into the cryostat via tubing 50 and the latent heat of phase transformation, whether fusion or sublimation, of the solid cryogen in the cryocell continues the desired cooling of focal plane array 28 which, depending upon the missile, can extend anywhere from 15 to 1000 seconds.

If cooling takes place by sublimation, valve 70 is opened at time of launch to permit the cryocell to vent into the ambient surroundings which are connected to space vacuum. If cooling takes place by fusion at the triple point, then valve 70 is not required.

Figure 2:
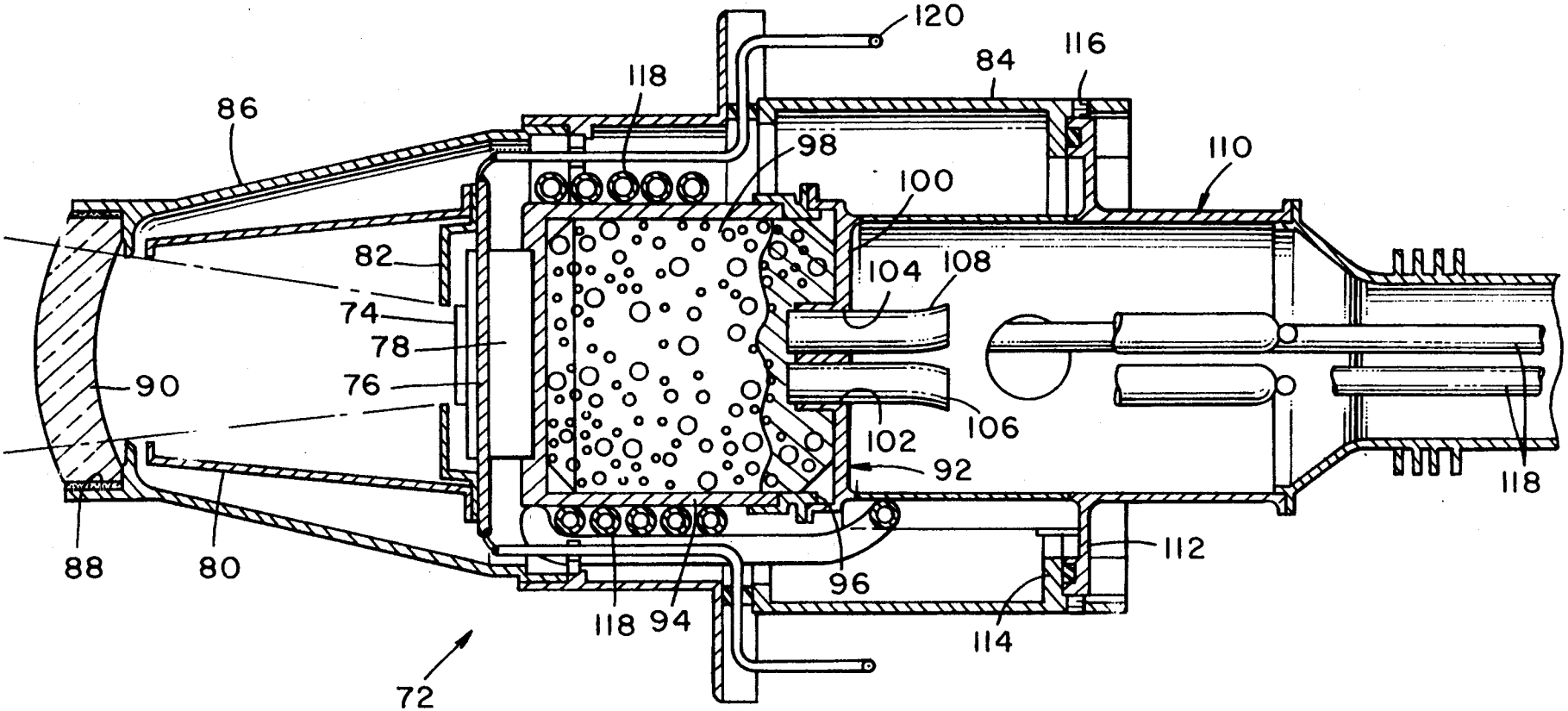
FIG. 2 is a side elevational, sectional view of another version of the present invention particularly for use with a liquid secondary cryocooler.
Figure 3:
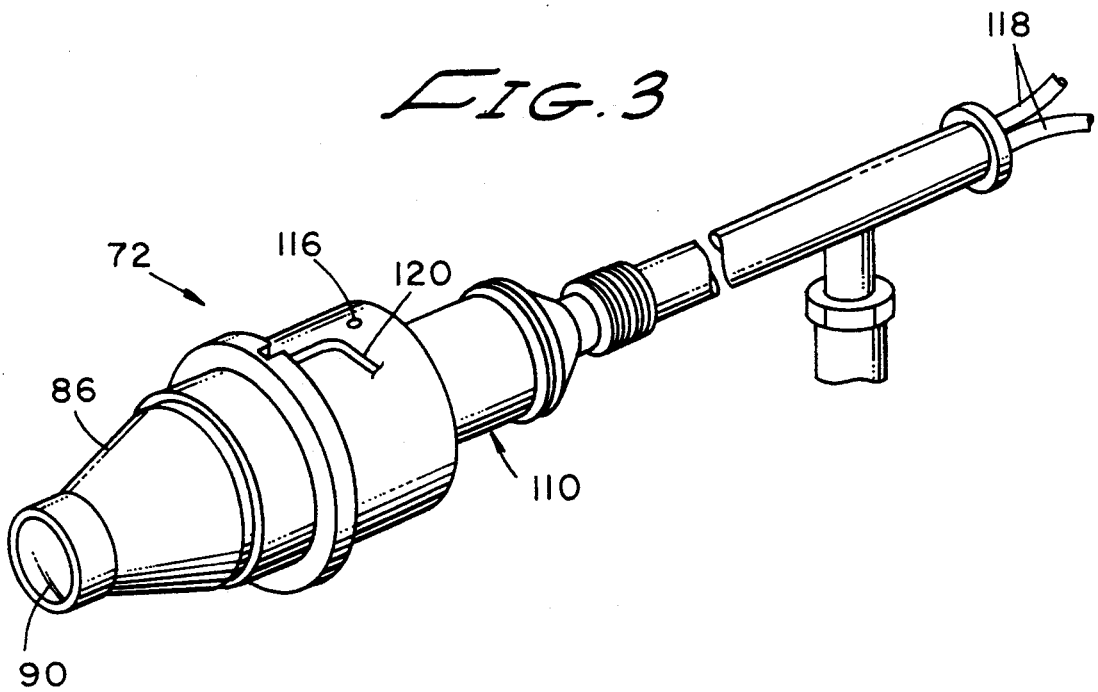
FIG. 3 is a perspective view of the apparatus of FIGS. 1 and 2 shown fully assembled.
Figure 4:
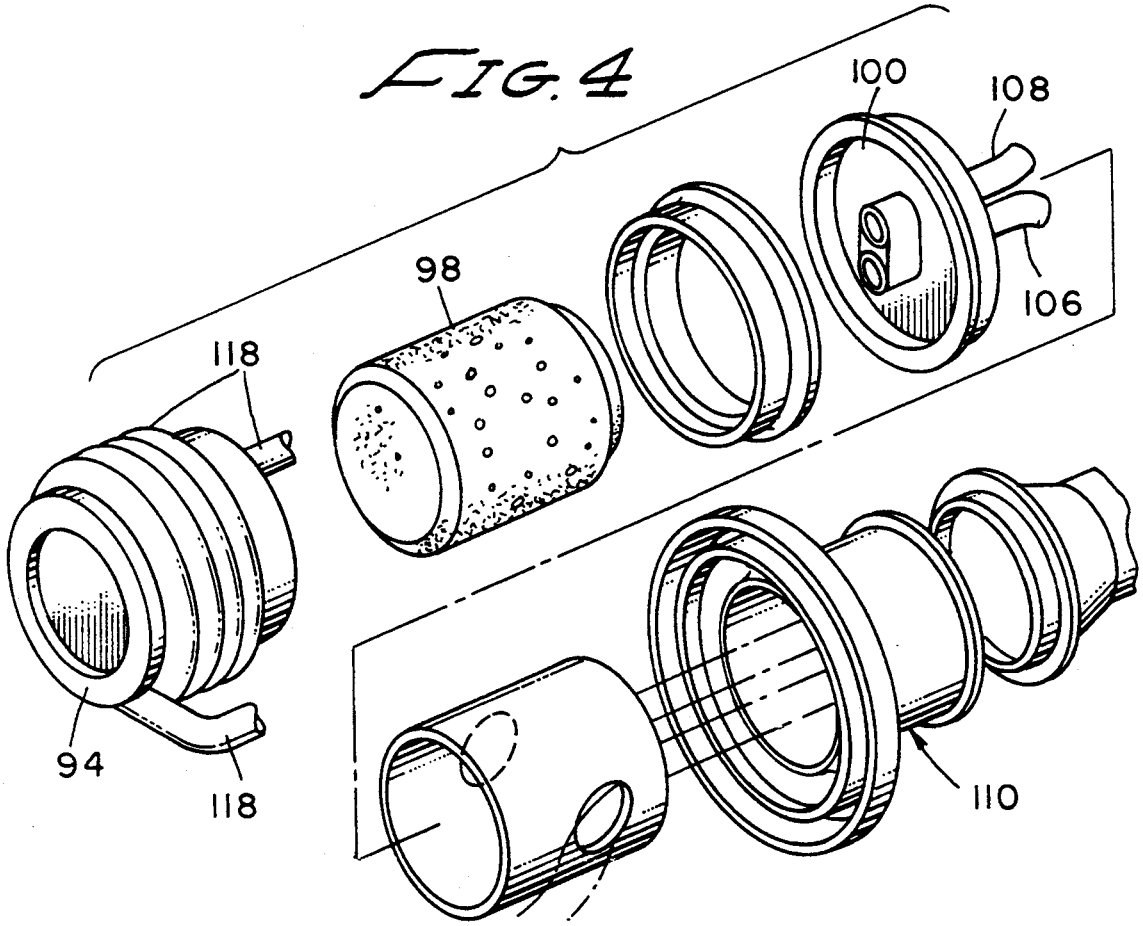
FIG. 4 is an exploded view of the apparatus of FIG. 2 showing its various parts in disassembly.

For the ensuing description of a further embodiment especially adaptable for use of a liquid secondary cryogen, reference is made to FIG. 2. The cryogenic cooling system depicted there enumerated as 72 is for the same general purpose as the first described, namely, for cooling apparatus or devices such as a focal plane array 74 carried in a missile. As before, the array 74 is secured to a major surface of a ceramic circuit card 76 that has its opposite major surface abutting against a platelike metal pedestal 78 in good heat conductive relation. A conical cold shield 80 has one end affixed over a light mask 82 to the circuit card 76.

A generally cylindrical open-ended housing 84 including a conical wall member 86 is received in enclosing relationship about the array, circuit card and pedestal. The conical wall member has an open end 88 located orthogonally opposite the focal plane array and within which a window 90 is fastened for transmitting light energy onto the array.

The cryocell 92 for cooling the array 74 is seen to include a metal-walled chamber 94 having an outer wall which abuts against pedestal 78 in good thermally conductive relationship, the side opposite being open at 96. The chamber interior is filled with a metal foam 98 (e.g. aluminum or copper) to achieve thermal equilibrium throughout the interior and the open side 96 is enclosed by a cover plate 100 having a pair of openings 102 and 104 within which tubings 106 and 108 are inserted via which the primary cryogen (e.g. propane) is added and vented, respectively.

A hollow cylinder 110 with a centrally located radial flange 112 is slidingly received within housing 84 and secured against an inwardly directed flange 114 by threaded means 116, for example. A length of metal tubing 118 is coiled about chamber 94 with its two ends extending outwardly along cylinder 110. Electrical connection to the circuit board is achieved by conventional feedthrough pins 120.

During assembly, the cryocell chamber 94 is charged with a gaseous or liquid primary cryogen (e.g. propane) via tubings 106, 108 which are then sealed off. The cryocell is cooled down by the liquid secondary cryogen pumped along tubing 118 through the coils surrounding chamber 94. In this manner, the array 74 and circuit board are brought to and maintained at the required low temperature prior to launch.

At launch time, the interconnection with the secondary cryogenic system via tubing 118 is broken and required cooling is provided entirely by the solid primary cryogen in chamber 94 throughout the missile free flight.

There is provided in accordance with this invention a lightweight, launch-ready cryosystem. In contrast to certain known systems, the described system only requires as little as 1 gram or less cryogen that is on board the missile after launch while many pounds of cryogen were necessary formerly. Also, where vapor pressure control had been necessary to accommodate ambient pressure and acceleration in certain known systems, excellent temperature stability is obtained in the present system during the triple-point phase transition in a sealed cryocell.

Furthermore, by using the latent heat of phase transformation of a relatively small cryogen pellet placed adjacent a focal plane array as described herein, a means of sustaining the requisite array cold temperature is achieved during the missile free flight, without recourse to cryogen input. Another advantage is the provision of a stable array cold temperature (triple-point temperature) to within tenths of a degree, which is free of the normally encountered thermophonic noise resulting from environmental factors in other systems. Exemplary of the weight advantage, the primary cryogen pellets can weigh less than 1 gram while other systems have required 200–500 grams. The light weight of the cryogen pellet further insures that a cooldown can be relatively quickly achieved. Cost effectiveness is enchanced since simplification in construction has eliminated many components formerly used.

In addition to propane, the primary cryogen may be made from other hydrocarbons, such as propylene, for example. These two cryogens have triple-point temperatures in the 85–88 degrees Kelvin range which makes the described invention suitable for direct cooling medium wavelength HgCdTe detectors. Lower phase transition temperatures, on the order of 75–80K, for cooling long wavelength HgCdTe detectors, may be achieved with eutectic hydrocarbon mixtures of propane and ethane.

The cryocells which remain on board the vehicle have been described as being filled and sealed throughout with the primary cryogen (e.g. propane). Cooling in this case from the sealed cell is provided by the heat of fusion and it has been shown that where 1.0 grams of propane is used, this provides approximately 100 seconds of cooling for the focal plane array. Alternatively, the cryocell may be opened at launch time to a reduced ambient pressure environment such as space vacuum which causes the solid cryogen pellet to sublimate, and change from a solid to a gas, with a latent heat that is enhanced many times by the addition of the heat of vaporization to the latent heat of fusion. In this latter case, the same 1.0 grams of propane provides 800 seconds of cooling.

Although a preferred embodiment has been disclosed and described in detail herein, it should be understood that this invention is in no sense limited thereby and can be modified in a number of ways and still come within the spirit of the invention, with its scope to be primarily determined by that of the appended claims.

What is claimed is:

1. A system for cooling an apparatus aboard a missile, comprising:

a chamber containing a first cryogen mounted on board the missile adjacent the apparatus;

means mounted adjacent the chamber in heat conducting relation therewith;

a source of supply of a second cryogen located externally and separately of the missile; and selectively disconnectable means for conduiting the second cryogen from the source of supply to the means mounted adjacent the chamber for cooling the first cryogen and apparatus.

2. A system as in claim 1, in which the chamber includes a thermal equilibriating means comprised of a quantity of aluminum metal foam as well as the first cryogen.

3. A system as in claim 1, in which the chamber includes a thermal equilibriating means comprised of a quantity of aluminum copper metal foam as well as the first cryogen.

4. A system as in claim 1, in which the chamber includes a plurality of spaced apart support and heat conducting posts interconnecting opposite walls defining said chamber, and said first chamber is located between said posts.

5. A system as in claim 1, in which the means mounted adjacent the chamber is a Joule-Thomson cryostat which is rendered non-operative by removing the input cooling gas line from the missile upon launch.

6. A system as in claim 1, in which the second cryogen consists of liquid nitrogen.

7. A system as in claim 6, in which the selectively disconnectable means includes a length of tubing having a part coiled about the chamber.

8. A system as in claim 1, in which the first cryogen is a liquified hydrocarbon solidified by the second cryogen.

9. A system as in claim 8, in which the liquified hydrocarbon is propane.

10. A system as in claim 8, in which the liquified hydrocarbon is propylene.

11. Missile on-board cooling apparatus, comprising:

a metal-walled container;

a supply of first cryogen within said container;

a source of supply of a second and liquid cryogen located externally and separately of the missile;

nozzle spray means positioned within the missile for directing a spray onto the metal-walled container;

a selectively disconnectable conduit interconnecting the nozzle spray means and the source supply of the second cryogen after spraying said container.

12. Missile on-board cooling apparatus as in claim 11, in which a further conduit interconnects the metal-walled container and the exterior of the missile, and means for selectively valving the further conduit.

13. On-board cooling apparatus for an airborne vehicle comprising:

a metal-walled chamber;

a quantity of a gaseous first cryogen located within said chamber;

tubelike means soiled about and in contact with the metal-walled chamber; and selectively disconnected conduit for interconnecting a source of second cryogen and the tubelike means.

* * * * *